US006250517B1

(12) United States Patent
Samz et al.

(10) Patent No.: US 6,250,517 B1
(45) **Date of Patent: *Jun. 26, 2001**

(54) INTEGRALLY-FORMED CONTAINER

(75) Inventors: John B. Samz, Union Grove; William C. Vogel, Milwaukee, both of WI (US)

(73) Assignee: Gateway Plastics, Inc., Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/374,976

(22) Filed: Aug. 16, 1999

Related U.S. Application Data

(63) Continuation of application No. 08/959,399, filed on Oct. 28, 1997, now Pat. No. 5,971,231.

(51) Int. Cl.[7] ..... B65D 51/18
(52) U.S. Cl. ..... 222/565; 222/480
(58) Field of Search ..... 222/480, 565, 222/556; 220/259, 254, 380

(56) References Cited

U.S. PATENT DOCUMENTS

| | | | |
|---|---|---|---|
| 181,615 | 8/1876 | Albertson . | |
| 1,773,553 | 8/1930 | Taylor et al. . | |
| 3,018,931 | 1/1962 | Westgate | 222/480 |
| 3,140,019 | 7/1964 | Barr | 222/480 |
| 3,180,537 | 4/1965 | Collins | 222/480 |
| 3,323,671 | 6/1967 | Minarik, Jr. et al. | 215/40 |
| 3,372,832 | 3/1968 | Yeater et al. | 220/254 |
| 4,284,200 | 8/1981 | Bush et al. | 215/215 |
| 4,538,731 | 9/1985 | Cillario | 220/254 |
| 4,610,371 | 9/1986 | Karkiewicz | 220/266 |
| 4,693,399 | 9/1987 | Hickman et al. | 222/480 |
| 4,714,181 | 12/1987 | Kozlowski et al. | 222/480 |
| 4,898,292 | 2/1990 | VerWeyst et al. | 215/237 |
| 4,936,494 | 6/1990 | Weidman | 222/480 |
| 4,955,513 | 9/1990 | Bennett | 222/480 |
| 5,085,331 | 2/1992 | Groya et al. | 215/245 |
| 5,219,100 | 6/1993 | Beck et al. | 222/480 |
| 5,339,993 | 8/1994 | Groya et al. | 222/153 |
| 5,509,582 | 4/1996 | Robbins, III | 222/158 |
| 5,971,231 | 10/1999 | Samz et al. | 222/480 |

*Primary Examiner*—Steven O. Douglas
(74) *Attorney, Agent, or Firm*—Foley & Lardner

(57) ABSTRACT

A food products container is disclosed having a cover with two integrally formed flaps for covering a plurality of cover openings, in particular a spooning opening and shaker openings. Skirts extending downward from the flaps engage their respective openings in the cover to seal them. The skirts that engage the openings extend downward and outward from the flaps at an angle. By extending outward and downward, the skirts engage and lock into the holes. A lip is provided at an outer edge of the cover on the flaps and on the non-rotating part of the cover to retain a second, identical container placed on top by engaging an outer indent in the bottom of the second container.

34 Claims, 3 Drawing Sheets

INTEGRALLY-FORMED CONTAINER

RELATED APPLICATION

This application is a continuation-in-part of U.S. patent application Ser. No. 08/959,399, now U.S. Pat. No. 5,971, 231, filed on Oct. 28, 1997, entitled "An Improved Integrally-Formed Container, which is hereby incorporated by reference therein.

FIELD OF THE INVENTION

This invention generally relates to hand-held plastic containers for storing and dispensing particulate matter. More particularly, it relates to such containers with a cover having a plurality of flaps for enclosing, respectively, a plurality of openings in the cover. More particularly, it relates to containers for foodstuffs having a shaker opening with a plurality of holes and a spooning opening with a large opening adapted to receive a common household spoon.

BACKGROUND OF THE INVENTION

In the field of hand-held plastic containers for storing and dispensing particulate matter, particularly foodstuffs or seasonings such as those displayed and sold in supermarkets, designers have desired to create containers that are easily stackable, having several openings, particularly openings for both shaking and spooning that have flaps to seal these openings, yet are inexpensive to manufacture in large quantities and are inexpensive to assemble.

These containers typically have a diameter of between 20 and 150 millimeters and are especially suitable for cooks who can spoon foodstuffs such as spices from a first opening and can shake the same foodstuffs from a second set of openings. Typically, the matter is spooned from the first opening and deposited into a bowl or other container for mixing food. The spooning opening is adapted to receive any one of a variety of common household spoons used for measuring foodstuffs. A second opening (or more accurately, several openings) on a second side of the cover are provided to allow the foodstuffs to be shaken out of the container. Typically, the shaker side of the container cover is useu when the foodstuffs are shaken directly into food that is being served, or food that is being seasoned "to taste" while it is cooking.

Manufacturers of these products must balance several conflicting goals. First, the container must seal tightly to prevent the foodstuffs from oxidizing, to prevent their flavors from evaporating and to prevent them from picking up any of the flavors of the adjacent foods. Second, the container must be inexpensive to manufacture, since the cost of the foodstuffs in the container is typically quite small. Third, the container must similarly be inexpensive to fill and assemble. Fourth, the container must easily and reliably stack on supermarket shelves to a typical height of three to five containers, since supermarket shelves are typically spaced several inches apart, and shelf space is at a premium.

Manufacturers have had mixed results with their designs. In a typical recent example in the prior art, a cover is provided that has two flaps, one flap having a skirt extending down from its lower surface to seal a spooning opening, and another flap having three skirts extending down from its lower surface to seal three shaker openings. The skirts extend at right angles from the lower surface of their respective flaps and are sized to snap fit within their respective openings to secure their respective flaps in a closed position. A drawback of this design is that the flaps are formed separately from the rest of the cover and thus a separate joining process is required. In an alternative prior art design, a two-flap cover having one spooning opening and one shaker opening, avoids the thick skirts of the previous example, and provides slightly rounded bumps on the inner surface of the shaker flap that seal against the corresponding shaker openings. A drawback to this design is the limited sealing ability of the cover with bumps since the bumps do not lock into the holes they cover.

What is needed, therefore, is an improved food products container having a cover formed integrally with a plurality of flaps that provides improved sealing. It is an object of this invention to provide such a cover.

SUMMARY OF THE PRESENT INVENTION

In accordance with a first embodiment of the invention, a cover for a food products container is disclosed including a cylindrical portion having a first and a second end, a means for coupling the cover to a container disposed on an inner surface of the cylindrical portion, a substantially planar and circular top portion coupled to and enclosing the first end of the cylindrical portion and having a plurality of shaker openings disposed on a first side of the top portion and a spooning opening disposed on a second side of the top portion, a shaker flap formed integrally with the top portion and having an outer edge with a downwardly extending skirt and hingably secured to the top portion to rotatingly open about a line adjacent to a diametral line of the top portion and disposed to selectively cover and uncover the plurality of shaker openings, and a spooning flap formed integrally with the top portion and having an outer edge with a downwardly extending skirt and hingably secured to the top portion to rotatingly open about a line adjacent to a diametral line of the top portion and disposed to selectively cover and uncover the spooning openings. The cylindrical portion may have a first recess disposed to receive the skirt extending from the spooning flap or a second recess disposed to receive the skirt extending from the shaker flap. The shaker flap and spooning flap may be recessed within the top portion at an outer edge of the top portion to provide in combination with the outer edge a container supporting surface or may have a raised lip with an outer diameter substantially the same as the outer diameter of the cylindrical portion. The spooning flap skirt when in a closed position may extend both downward with respect to the spooning flap and outward with respect to a central axis of the cover. The raised lip on the shaker flap may be coupled to the shaker flap at a position disposed outwardly from a position at which the shaker flap skirt is coupled to the shaker flap. The raised lip on the spooning flap may be coupled to the spooning flap at a position disposed outwardly from a position at which the spooning flap skirt is coupled to the spooning flap. The top portion may include a raised lip disposed at an edge of the top portion adjacent to the cylindrical portion. The raised lip of the top portion may have substantially the same diameter as the raised lip of the shaker flap and the raised lip of the spooning flap.

In accordance with a second embodiment of the invention, a closed-bottom receptacle with an otherwise open and cylindrical upper end coupled to and enclosed by the cover. The receptacle may have a first annular recess disposed at its upper end to receive the cylindrical portion of the cover. An outer surface of the receptacle may be substantially cylindrical and may have a diameter substantially the same as an outer diameter of the cover. A raised lip may be provided extending from both the shaker flap and the spooning flap, and the receptacle may have a second annular recess disposed at a closed bottom of the receptacle to receive the shaker flap lip and the spooning flap lip. The shaker flap and the spooning flap may be recessed within the top portion at an outer edge of the top portion to provide in combination with the outer edge a container supporting surface. The shaker flap and spooning flap may have a raised lip with a diameter substantially the same as the outer diameter of the cylindrical portion. The top portion may also include a raised lip disposed at an edge of the top portion adjacent to the cylindrical portion. The raised lip of the top portion may have substantially the same diameter as the raised lip of the shaker flap and the raised lip of the spooning flap.

Other principal features and advantages of the invention will become apparent to those skilled in the art upon review of the following drawings, the detailed description and the appended claims.

Figure 1:
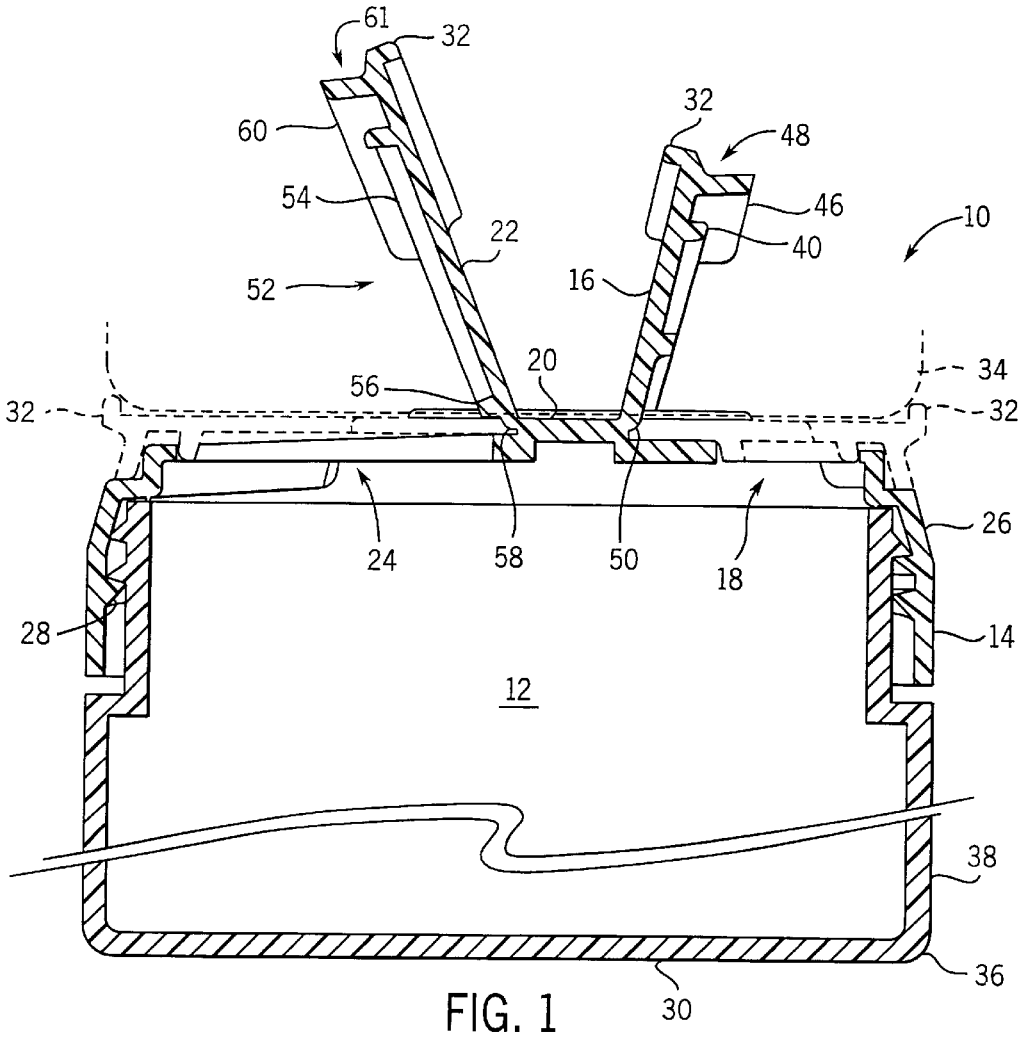
FIG. 1 is a cross-sectional side view of a container including a cover and receptacle in accordance with the current invention showing the flaps in an open position and as dashed lines in a closed position.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

FIG. 1 illustrates a container 10 having a receptacle 12 and a cover 14. Cover 14 includes a shaker flap 16, called a shaker flap because it covers (when closed) shaker openings 18 disposed in planar top portion 20 of the cover. Cover 14 also includes a spooning flap 22 that similarly covers a larger spooning opening 24 also disposed in top portion 20.

Figure 2:
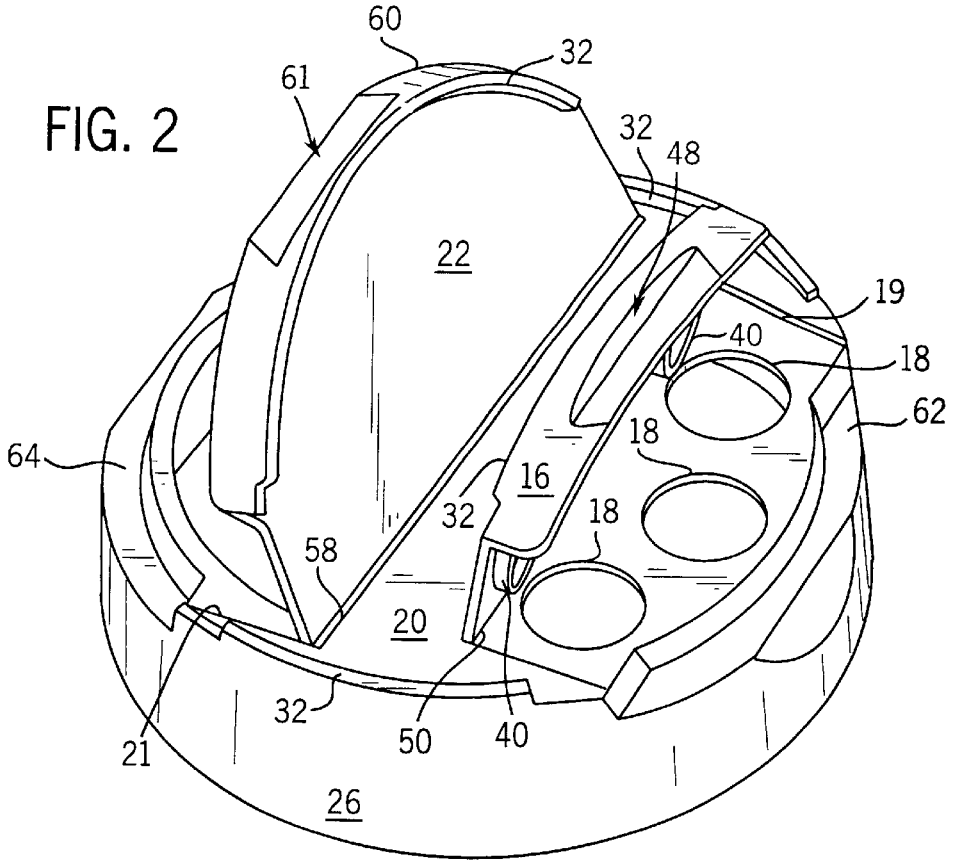
FIG. 2 is an orthogonal view of the cover of FIG. 1, showing the flaps in an open position.

The cover as best seen in FIG. 2, is in the form of a substantially cylindrical portion 26, and top portion 20 which is coupled to an upper end of cylindrical portion 26 to enclose cylindrical portion 26. Referring to FIG. 1, which shows a portion of the cover in cross-section with the receptacle attached, threads 28 are provided on the inner surface of cylindrical portion 26 for coupling cylindrical portion 26 to the outside of the top of receptacle 12. As seen in FIG. 1, mating threads are disposed on an outer indented top portion of receptacle 12 to engage threads 28. Alternatively, cylindrical portion 26 may be equipped with an inner detent or a raised ring to allow it to be snap connected to the top portion of receptacle 12. Referring to FIG. 2, an elongate recess 19 is provided in which shaker flap 16 will fit when flap 16 is in a closed position, to provide a substantially flat upper surface of top portion 20 on which a similar container can be stacked.

Referring back to FIG. 1, receptacle 12 includes a substantially planar bottom portion 30 that is adapted to engage a lip 32 of cover 14. There is a significant advantage to this feature: since the bottom portion 30 is adapted to engage lip 32, then a plurality of containers identical to the one pictured in FIGS. 1 and 2 can be stacked one atop the other, lip 32 serving to orient the bottom of the next higher container and so keep the containers in proper alignment when stacked. In FIG. 1, two identical containers are shown in this stacked arrangement, the bottom of the upper container being shown as dashed line 34 engaging rim 32 when the flaps of the lower container are in a closed position (shown in FIG. 1 as dashed lines when in their closed positions). It can be seen that bottom portion 30 (and hence identical bottom portion 34) are adapted to engage one another. Lip 32 is disposed at an outer edge of cover 14 to engage a recess 36 at the junction of bottom 30 and wall 38 of receptacle 12. By disposing both lip 32 and recess 36 to engage each other near the outer periphery of the container, study has shown that the containers, are more easily stacked, and when stacked tend to self-center. A portion of lip 32 is preferably disposed on shaker flap 16, spooning flap 22 as well as on the non-hinged sides of top portion 20 as can be best seen in FIG. 4. Each of these portions is preferably disposed at an outer edge of cover 14 and have substantially the same diameter. Other designs, provide orienting means disposed more closely to the center of the container, such as my providing an indentation at or near the center of the receptacle bottom that engages with an upwardly extending protrusion located near the center of the cover on which it is stacked, are more difficult to stack accurately and also tend to tip more easily. In addition, it is harder to hold tolerances on an inner indentation than an outer indentation as shown in FIG. 1. These designs have the added disadvantage of requiring an internal recess to be formed in the center of the receptacle bottom, requiring additional machining to manufacture.

Referring to FIG. 2, a plurality of oval shaker openings 18, preferably substantially circular as shown here, are provided to allow foodstuffs within the container to be shaken out when shaker flap 16 is opened. These openings are preferably arranged not along a straight line, but along an arc. Along the underside of shaker flap 16 are a plurality of skirts 40 adapted to engage and seal shaker openings 18 one for each of shaker openings 18. Each of these skirts extends substantially completely around the periphery of its corresponding opening 18 when in a closed position. In this embodiment, since the shaker openings 18 are substantially circular, the shaker flap skirts 40 are therefore substantially circular also to provide complete peripheral sealing of shaker openings 18.

Figure 4:
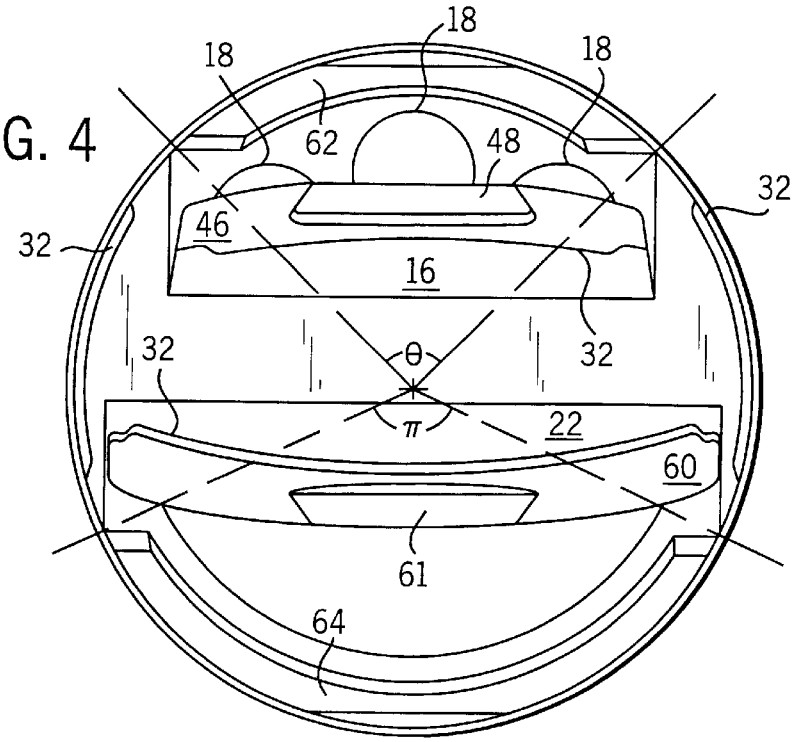
FIG. 4 is a top view of the cover of FIG. 1 with the flaps in an open position.
Figure 3:
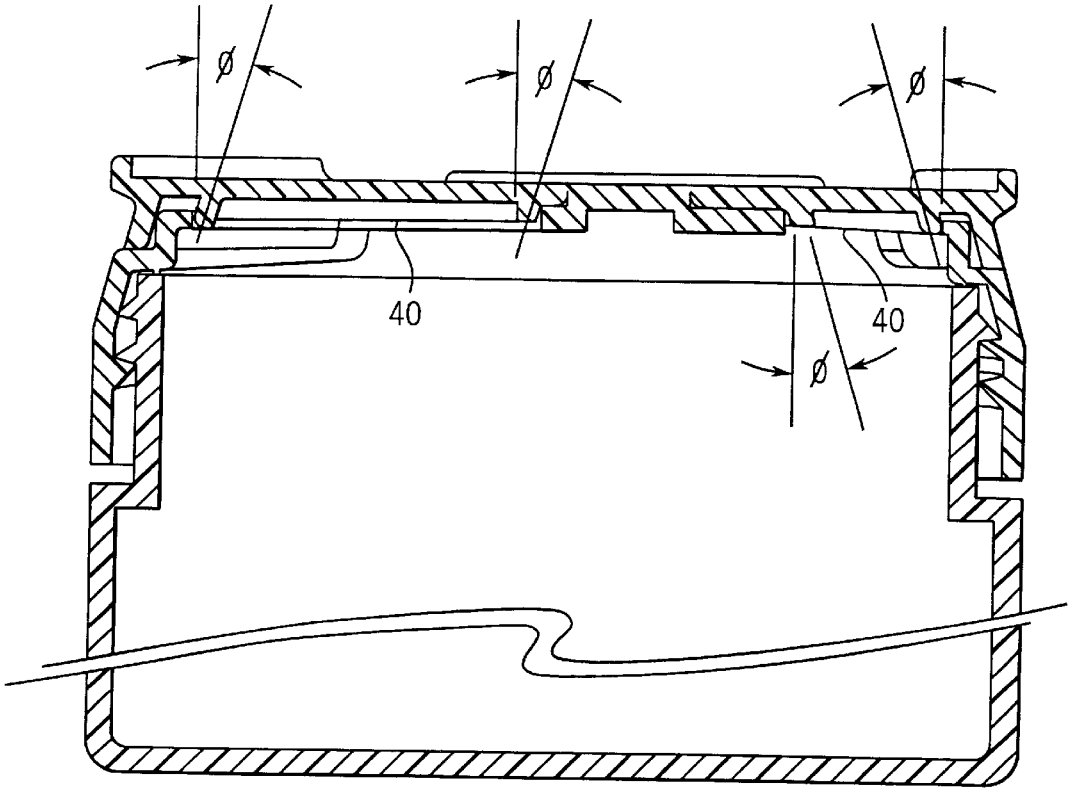
FIG. 3 is a cross-sectional view of the container of FIG. 1 showing the angled orientation of the flap skirts.

As best seen in cross-section in FIG. 3, which shows cover 14 in cross-section along a diametral line of the cover perpendicular to both the shaker flap hinge 50 and the spooning flap hinge 58 with both the shaker and the spooning flap in a closed position, skirts 40 do not extend perpendicularly from the underside of shaker flap 16. Indeed, skirts 40 extend at an angle phi of between 9 and 25 degrees, and more preferably of between 5 and 20 degrees, from the bottom of shaker flap 16 with respect to a plane parallel to the longitudinal axis of container 10 and to hinge 50. This angle is particularly beneficial in that it allows the cover, including the flaps, to be readily and integrally molded as a single monolithic piece. In addition, this angle allows skirts 40 to releasably lock into their closed position when shaker flap 16 is closed. Shaker flap 16 also includes a skirt 46 that extends downwardly from shaker flap 16 at a similar angle phi. Skirt 46 extends from shaker flap 16 near an outer edge of shaker flap 16 and has an arcuate shape to define an outer substantially vertical surface of cover 14 when shaker flap 16 is in a closed position. Skirt 46 has an indentation 48 disposed at a central outer portion of skirt 46 and is configured to receive a finger or fingernail of the user. This allows the user to grasp shaker flap 16 and readily open container 10. Skirt 46 preferably extends around cover 14 for an angle theta of between 60 and 120 degrees (see FIG. 4). From an outward appearance, therefore, skirt 46 would appear to form between 60 and 120 degrees of the circumference of the upper part of cover 14. This provides a significant advantage in the design of cover 14. Since skirt 46 is arcuate, rather than straight, it is less likely to be bent over when the cover is grasped and opened, and further distributes the grasping load more evenly around the outer edge of shaker flap 16. This allows shaker flap 16 to be made thinner and therefore to require less plastic when manufactured. Referring to FIG. 4, when the shaker flap 16 is closed, an outer portion of skirt 40 engages an outer portion of shaker opening 18 to thereby releasably lock shaker flap 16 to top portion 20 in a closed position. While only a single skirt 40 is shown in cross section in FIG. 4, the other shaker skirts for the other two shaker openings are identically configured to releasably lock top portion 20 to shaker flap 16. Shaker flap 16 is coupled to top portion 20 by a flexible and integrally formed hinge 50 preferably extending the entire length of shaker flap 16. Spooning flap 22 is coupled to top portion 20 by a flexible and integrally formed hinge 58 preferably extending the length of spooning flap 22. Note that, unlike certain prior art covers with hingable flaps, hinges 50 and 58 are disposed adjacent to a diametral line of cover 14 to allow the flaps to hinge upward and toward the middle of cover 14. In prior art covers, the hinges were formed along an outer edge of the cover, which allowed the flaps to be opened upward and outward. This caused the flap to dangle in its open position and in the way of the material being shaken out of the container, causing it to be covered with the foodstuffs or other materials inside. The advantage of this prior art design, however, was that it allowed the top portion of the cover and its flap to be easily formed with a two piece mold as an integral unit.

Spooning flap 22 similarly encloses spooning opening 24. Spooning flap 22 has a skirt 52 depending from a lower surface of spooning flap 22 that includes an arcuate portion 54 and a substantially straight portion 56. Straight portion 56 extends substantially parallel to and disposed a short distance away from hinge 58 that couples spooning flap 22 to top portion 20. As with skirts 40 on the shaker flap, straight portion 56 does not extend perpendicularly from the underside of spooning flap 22, but extends at an angle phi of between 9 and 25 degrees from the underside of spooning flap 22, more preferably between 5 and 20 degrees with respect to a plane parallel to the longitudinal axis of container 10 and to hinge 58. As with skirt 40 of the shaker flap, by disposing straight portion 56 at this angle, cover 14 can be manufactured in a single piece with spooning flap 22 formed integrally with cover 14. Similarly, arcuate portion 54 of skirt 52 also extends downward and at an angle phi of between 9 and 25 degrees, more preferably between 5 and 20 degrees, from the underside of spooning flap 22 with respect to a plan parallel to the longitudinal axis of container 10 and to hinge 58. Arcuate portion 54 preferably extends through an arc having an angle of between 120 and 180 degrees to provide a sufficiently large spooning opening. Arcuate portion 54 engages an outer lip of spooning opening 24 to releasably lock spooning flap 22 to top portion 22 when spooning flap 22 is in a closed position. Spooning flap 22 also includes a skirt 60 that extends downwardly from spooning flap 22 near an outer edge of spooning flap 22 and has an arcuate shape to define an outer substantially vertical surface of cover 14 when spooning flap 22 is in a closed position. Skirt 60 has an indentation 61 disposed at a central outer portion of skirt 60 and is configured to receive a finger or fingernail of the user. This allows the user to grasp spooning flap 22 and readily open container 10. Skirt 60 preferably extends around cover 14 when in the closed position for an angle pi of between 100 and 150 degrees (see FIG. 4). From an outward appearance, therefore, skirt 60 would appear to form between 100 and 150 degrees of the circumference of the upper part of cover 14. As with skirt 46 of shaker flap 16, since skirt 60 is arcuate, rather than straight, it has greater structural strength and it is less likely to be bent over when its flap is grasped and opened, and further distributes the grasping load more evenly around the outer edge of spooning flap 22. This allows spooning flap 22 to be made thinner and therefore to require less plastic when manufactured. Note that the arcuate length of skirt 60 is greater than the arcuate length of skirt 46. This is desirable and provides additional support to spooning flap 22 given the greater length of arcuate portion 54 which therefore provides a greater portion of skirt 52 that is in locking contact with spooning opening 24 and hence requires a greater opening force. This additional arcuate length of skirt 60 therefore provides additional strength to spooning flap 22 when the user attempts to open spooning flap 22.

A recess 62 is provided in the cylindrical portion of cover 14 to receive skirt 46 of shaker flap 16. By providing recess 62, skirt 46 can be set into an outer surface of cover 14 when shaker flap is closed, thereby reducing the risk that skirt 46 will be accidentally jostled and caught, shaker flap 16 opened and the contents of container 10 spilled. Similarly, a recess 64 is provided in cover 14 on the opposite side of cover 14 from recess 62 to similarly receive skirt 60 of spooning flap 22 for the same reason. The effect of skirts 46 and 60 being recessed is that the skirts form a smooth and contiguous part of the cylindrical portion of cover 14.

Thus, it should be apparent that there has been provided in accordance with the present invention an improved integrally-formed container that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A container comprising:

a cover including, a cylindrical portion having a first and a second end, cover threads disposed on an inner surface of the cylindrical portion, a substantially planar and circular top portion coupled to and enclosing the first end of the cylindrical portion and having a plurality of relatively large shaker openings disposed on a first side of the top portion, a shaker flap formed integrally with the top portion and having an outer edge with a downwardly extending skirt and hingably secured to the top portion to rotatingly open about a line adjacent to a diametral line of the top portion and disposed to selectively cover and uncover the plurality of shaker openings; and a closed-bottom receptacle having an otherwise open and cylindrical upper end coupled to and enclosed by the cover, the upper end having external receptacle threads configured to engage the cover threads, wherein the receptacle has a first annular recess disposed at its upper end to receive the cylindrical portion of the cover, and further wherein an outer surface of the receptacle is substantially cylindrical, and further comprising a raised lip extending from the cover, and further wherein the receptacle has a second annular recess disposed at a closed bottom of the receptacle configured to receive a raised lip extending from an identical cover.

2. The container of claim 1, wherein the raised lip extending from the cover includes a raised lip extending from the shaker flap.

3. The container of claim 1, wherein the raised lip extending from the cover includes a raised lip extending from the top portion.

4. The container of claim 1, wherein the raised lip extends in an arc about the cover and is adjacent to the cylindrical portion.

5. The cover of claim 1 further comprising a shoulder on the underside of the top portion configured to provide a seal for the open and cylindrical upper end of the closed bottom receptacle.

6. A container comprising:

a cover including, a cylindrical portion having a first and a second end, a substantially planar and circular top portion coupled to and enclosing the first end of the cylindrical portion and having a plurality of shaker openings disposed on a first side of the top portion and a spooning opening disposed on a second side of the top portion, a shaker flap formed integrally with the top portion and hingably secured to the top portion and disposed to selectively cover and uncover the plurality of shaker openings, a spooning flap formed integrally with the top portion and hingably secured to the top portion and disposed to selectively cover and uncover the spooning opening and a raised lip extending from both the shaker flap and the spooning flap; and a closed-bottom receptacle having an otherwise open and cylindrical upper end coupled to and enclosed by the cover, wherein the receptacle has a first annular recess disposed at its upper end to receive the cylindrical portion of the cover, and further wherein an outer surface of the receptacle is substantially cylindrical and has a diameter substantially the same as an outer diameter of the cover, and further wherein the receptacle has a second annular recess disposed at a closed bottom of the receptacle configured to receive a raised lip of an identical cover.

7. The container of claim 6, wherein the shaker flap and the spooning flap are recessed in the top portion.

8. The container of claim 7, wherein the shaker flap and the spooning flap are recessed in the top portion at an outer edge of the top portion to provide in combination with the outer edge a container supporting surface.

9. The container of claim 8, wherein the raised lip of the shaker flap and the spooning flap have a diameter substantially the same as the outer diameter of the cylindrical portion.

10. The container of claim 9, wherein the top portion includes a raised lip disposed at an edge of the top portion adjacent to the cylindrical portion.

11. The container of claim 10, wherein the raised lip of the top portion and the raised lip of the spooning flap are disposed at an outer edge of the cap.

12. An integrally formed cover comprising:

a cylindrical portion;

a top portion having a plurality of shaker openings and a spooning opening;

a shaker flap configured for movement between an open position and a closed position in which the shaker openings are closed;

a spooning flap configured for movement between an open position and a closed position in which the spooning opening is closed; and at least one projection extending from the spooning flap at an acute angle and providing a profile configured to form a releasable lock with the spooning opening when the spooning flap is moved to a closed position.

13. The cover of claim 12 further comprising at least one projection extending from the shaker flap at an acute angle and providing a profile configured to form a releasable lock with one or more of the shaker openings when the shaker flap is moved to a closed position.

14. The cover of claim 13 wherein at least one projection of the shaker flap progressively moves along a first mating profile defined by one or more of the shaker openings when the shaker flap is moved to the closed position.

15. The cover of claim 14 wherein at least one projection of the spooning flap progressively moves along a second mating profile defined by the spooning opening.

16. The cover of claim 15 wherein the releasable lock provides a retaining force.

17. The cover of claim 13 further comprising a projection on the shaker flap to indicate the presence of the shaker openings.

18. The cover of claim 17 wherein the shaker flap has a lip.

19. The cover of claim 18 further comprising a shoulder on the underside of the top portion.

20. The cover of claim 12 wherein the releasable lock of the spooning flap is provided by engagement between at least one projection and the spooning opening.

21. An integrally formed cover comprising:

a cylindrical portion;

a top portion having a plurality of shaker openings and a spooning opening;

a shaker flap configured for movement between an open position and a closed position in which the shaker openings are closed;

a spooning flap configured for movement between an open position and a closed position in which the spooning opening is closed; and at least one projection extending from the shaker flap at an acute angle and providing a profile configured to form a releasable lock with one or more of the shaker openings when the shaker flap is moved to a closed position.

22. The cover of claim 21 further comprising at least one projection extending from the spooning flap at an acute angle and providing a profile configured to form a releasable lock with the spooning opening when the spooning flap is moved to a closed position.

23. The cover of claim 22 wherein at least one projection of the spooning flap progressively moves along a first mating profile defined by the spooning opening when the spooning flap is moved to the closed position.

24. The cover of claim 23 wherein at least one projection of the shaker flap progressively moves along a second mating profile defined by one or more of the shaker openings.

25. The cover of claim 24 wherein the releasable lock provides a retaining force.

26. The cover of claim 22 further comprising a projection on the spooning flap to indicate the presence of the spooning opening.

27. The cover of claim 26 wherein the spooning flap has a lip.

28. The cover of claim 27 further comprising a shoulder on the underside of the top portion.

29. The cover of claim 21 wherein the releasable lock of the shaker flap is provided by engagement between at least one projection and one or more of the shaker openings.

30. An integrally formed cover for a container comprising:

a cylindrical portion;

a top portion having a plurality of shaker openings and a spooning opening;

a shaker flap having an outer edge with a downwardly extending skirt and coupled to the top portion and configured for selective movement between an open position in which the shaker openings are opened and a closed position in which the shaker openings are closed;

a spooning flap having an outer edge with a downwardly extending skirt and coupled to the top portion and configured for selective movement between an open position in which the spooning opening is opened and a closed position in which the spooning opening is closed; and an upwardly projecting lip extending substantially around an outer portion of one or more of the top portion, the shaker flap and the spooning flap, whereby the lip provides a guide for positioning a container bottom stacked on top of the cover.

31. The cover of claim 30, wherein the cylindrical portion has a first recess disposed to receive the skirt extending from the spooning flap.

32. The cover of claim 31, wherein the cylindrical portion has a second recess disposed to receive the skirt extending from the shaker flap.

33. The cover of claim 32, wherein the shaker flap and the spooning flap are recessed within the top portion.

34. The cover of claim 33, wherein the skirt extending from the spooning flap and the skirt extending from the shaker flap extend downwards and outwards away from a central axis of the cap.

* * * * *

Disclaimer

6,250,517 B1—John B. Samz, Union Grove; William C. Vogel, Milwaukee, both of WI (US). INTEGRALLY-FORMED CONTAINER. Patent Dated June 26, 2001. Disclaimer filed June 9, 2005 by Assignee, Gateway Plastics, Inc.

Hereby enters this disclaimer to claims 1-5 and 30-33, of said patent.

*(Official Gazette, September 20, 2005)*